US007792443B2

(12) United States Patent
Yamane

(10) Patent No.: US 7,792,443 B2
(45) Date of Patent: Sep. 7, 2010

(54) IMAGE FORMING APPARATUS CONTROLLING THE VOLTAGE APPLIED TO THE DEVELOPING MEMBER

(75) Inventor: Tutomu Yamane, Tokyo (JP)

(73) Assignee: Oki Data Corporation, Tokyo (JP)

( * ) Notice: Subject to any disclaimer, the term of this patent is extended or adjusted under 35 U.S.C. 154(b) by 423 days.

(21) Appl. No.: 11/863,304

(22) Filed: Sep. 28, 2007

(65) Prior Publication Data

US 2008/0080884 A1 Apr. 3, 2008

(30) Foreign Application Priority Data

Sep. 29, 2006 (JP) ..... 2006-266223

(51) Int. Cl.
*G03G 15/02* (2006.01)
*G03G 15/06* (2006.01)

(52) U.S. Cl. ..... 399/50; 399/55

(58) Field of Classification Search ..... 399/128, 399/50, 55, 56

See application file for complete search history.

(56) References Cited

U.S. PATENT DOCUMENTS 4,063,811 A * 12/1977 Seino et al. ..... 399/128
4,432,631 A * 2/1984 Bacon et al. ..... 399/50
4,538,901 A * 9/1985 Soumiya ..... 399/128
4,933,721 A * 6/1990 Yasuda et al. ..... 399/128

FOREIGN PATENT DOCUMENTS

JP 1100563 A 4/1989
JP 05-072878 3/1993
JP 11052689 A 2/1999
JP 11084834 A 3/1999
JP 11190931 A 7/1999
JP 2000098703 A 4/2000
JP 2002365858 A 12/2002

OTHER PUBLICATIONS

Office Action mailed Feb. 10, 2009 in related Japanese Application No. 2006-266223.
Office Action mailed May 12, 2009 in related Japanese Application No. 2006-266223.
Office Action mailed Aug. 11, 2009 in related Japanese Application No. 2006-266223.
Office Action mailed Nov. 10, 2009 in related Japanese Application No. 2006-266223.
Office Action mailed Aug. 11, 2009 in related Japanese Application No. 2009-096954.

* cited by examiner

*Primary Examiner*—Susan S Lee
(74) *Attorney, Agent, or Firm*—Panitch Schwarze Belisario & Nadel LLP

(57) ABSTRACT

An image forming apparatus includes: an image carrier; a charging member; a developing member; a supplying member; an electrostatic removing unit; a developing member voltage application unit applying a voltage to the developing member; a supplying member voltage application unit applying a voltage to the supplying member; an electrostatic removing unit voltage application unit applying a voltage to the electrostatic removing unit; and a voltage application control unit controlling the voltage applied to the developing member, the voltage applied to the supplying member, and the voltage applied to the electrostatic removing unit. Where the voltage applied to the charging member is changed, the voltage application control unit controls the electrostatic removing unit voltage application unit not to apply the voltage to the electrostatic removing unit.

10 Claims, 11 Drawing Sheets

IMAGE FORMING APPARATUS CONTROLLING THE VOLTAGE APPLIED TO THE DEVELOPING MEMBER

BACKGROUND OF THE INVENTION

1. Field of the Invention

This invention relates to an image forming apparatus such as an electrophotographic printer and a copying machine.

2. Description of Related Art

A conventional image forming apparatus has an exposure device expose a surface of a photosensitive drum uniformly charged by a charging device to form an electrostatic latent image thereon and has a developing device develop the electrostatic latent image to form a toner image, and subsequently transfers the toner image onto a medium and fixes the image thereon. Such a conventional image forming apparatus applies a voltage of a polarity opposite to the toner to a developing roller.

The conventional image forming apparatus has a problem that where a voltage of a polarity opposite to the toner is applied to the developing roller and subsequently the applied voltage is switched to a voltage of the same polarity as the toner, the amount of toner attached to the developing roller increases to cause a higher toner potential, and thus, the increased toner adversely moves to the photosensitive drum irrespectively of the electrostatic latent image during printing. The conventional image forming apparatus has a drawback in that the toner having moved to the photosensitive drum further moves to a recording paper to smear the recording paper.

BRIEF SUMMARY OF THE INVENTION

This invention is made to solve the above-mentioned problem, and it is an object of the present invention to provide an image forming apparatus that suppresses the potential of the toner attached to the developing roller and prevents the toner from moving from the developing roller to the photosensitive drum irrespectively of the electrostatic latent image.

According to a preferred embodiment of this invention, the image forming apparatus includes an image carrier rotating and having an electrostatic latent image formed by exposure of a charged surface of the image carrier to light and developed with a developer charged to a predetermined polarity, a charging member charging the image carrier, a developing member arranged on a downstream side in a rotational direction of the image carrier with respect to the charging member for attaching the developer onto the image carrier to develop the formed electrostatic latent image, a supplying member supplying the developer to the developing member, a developing member voltage application unit applying a voltage to the developing member, a supplying member voltage application unit applying a voltage to the supplying member, and a voltage application control unit controlling the voltage applied to the developing member by the developing member voltage application unit and the voltage applied to the supplying member by the supplying member voltage application unit, wherein, from when a prescribed portion on the image carrier charged by the charging member reaches the developing member along with the rotation of the image carrier to when the voltage begins to be applied to the supplying member, the voltage application control unit controls the developing member voltage application unit to apply to the developing member a voltage equal to or less than a difference between a voltage applied by the developing member voltage application unit to the developing member during image formation and a voltage applied by the supplying member voltage application unit to the supplying member during image formation.

In another aspect of the invention, the image forming apparatus includes an image carrier rotating and having an electrostatic latent image formed by exposure of a charged surface of the image carrier to light and developed with a developer charged to a predetermined polarity, a charging member charging the image carrier, a developing member arranged on a downstream side in a rotational direction of the image carrier with respect to the charging member for attaching the developer onto the image carrier to develop the formed electrostatic latent image, a supplying member supplying the developer to the developing member, a developing member voltage application unit applying a voltage to the developing member, a supplying member voltage application unit applying a voltage to the supplying member, and a speed control unit controlling a rotational speed of the image carrier, wherein the speed control unit controls the image carrier so that the image carrier rotates at a speed slower than a speed during image formation for a prescribed period from when a prescribed portion on the image carrier charged by the charging member reaches the developing member along with the rotation of the image carrier.

In still another aspect of the invention, the image forming apparatus includes an image carrier rotating and having an electrostatic latent image formed by exposure of a charged surface of the image carrier to light and developed with a developer charged to a predetermined polarity, a charging member charging the image carrier, a developing member arranged on a downstream side in a rotational direction of the image carrier with respect to the charging member for attaching the developer onto the image carrier to develop the formed electrostatic latent image, a supplying member supplying the developer to the developing member, an electrostatic removing unit neutralizing a potential on the surface of the image carrier, a developing member voltage application unit applying a voltage to the developing member, a supplying member voltage application unit applying a voltage to the supplying member, an electrostatic removing unit voltage application unit applying a voltage to the electrostatic removing unit, and a voltage application control unit controlling the voltage applied to the developing member by the developing member voltage application unit, the voltage applied to the supplying member by the supplying member voltage application unit, and the voltage applied to the electrostatic removing unit by the electrostatic removing unit voltage application unit, wherein where the voltage applied to the charging member is changed, the voltage application control unit controls the electrostatic removing unit voltage application unit not to apply the voltage to the electrostatic removing unit.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown.

In the drawings.

DETAILED DESCRIPTION OF THE INVENTION

The image forming apparatus of the present invention is hereinafter described with reference to the figures. It should be understood that the image forming apparatus of the present invention is not limited to embodiments described below, and can be modified as necessary within the scope of the spirit of the invention. It should be assumed that all magnitudes, increments, and decrements of voltages and potentials in the below description refer to absolute values unless otherwise explicitly specified. For example, where a voltage changes from −100V to −300V, the absolute value thereof changes from 100V to 300V, and thus, this change is expressed as the increment of voltage.

First Embodiment

Figure 2:
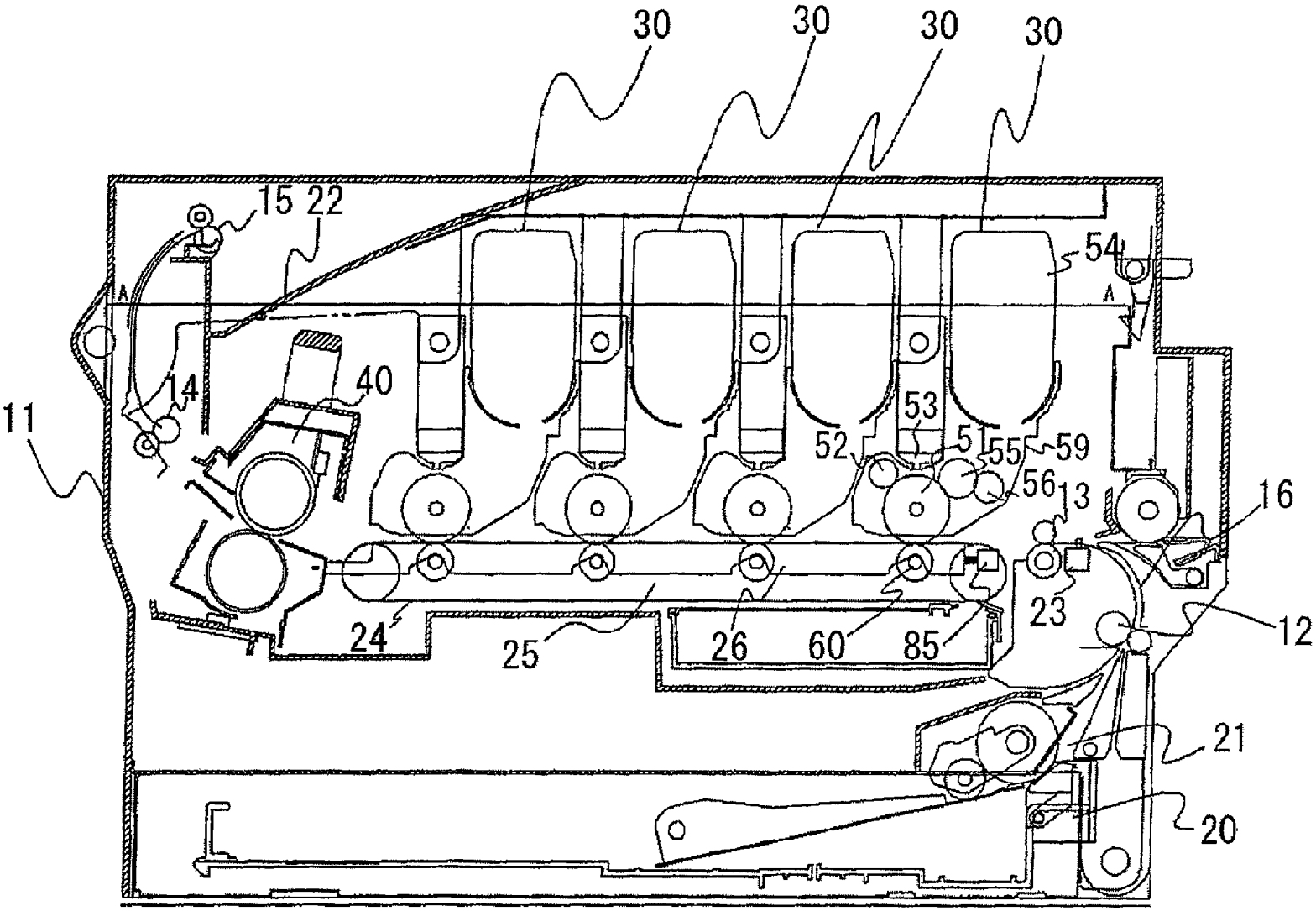
FIG. 2 is a schematic diagram of the image forming apparatus according to the first embodiment of the present invention.

As shown in FIG. 2, the image forming apparatus has a plurality of rollers 12, 13, 14, and 15 and a paper conveyance path 16 substantially in a shape of S for conveying a recording paper as a recording medium inside a lower frame 11. A paper feeding cassette 20 for containing the recording paper and a paper feeding unit 21 for feeding the recording paper from the paper feeding cassette 20 are arranged at the most upstream end of the paper conveyance path 16. A stacker 22 for stacking the printed and discharged recording paper is arranged at the most downstream end of the paper conveyance path 16.

The image forming apparatus has a thickness detection unit 23 in a proximity of the roller 13 on the paper conveyance path 16 for detecting a thickness of the recording paper based on a detection signal, a transfer belt unit 25 for causing the recording paper fed from the paper cassette 20 to electrostatically adhere to a transfer belt 24 to convey the recording paper, and a position alignment mechanism 26 for changing a position of a transfer roller 60 depending on the thickness of the recording paper detected by the thickness detection unit 23.

The image forming apparatus has four developing units 30 at positions opposite to the transfer belt unit 25 across the paper conveyance path 16 for forming toner images in four colors, for example, yellow (Y), magenta (M), cyan (C), and black (K). Each of the developing units 30 has an image drum and the like corresponding to each color. The developing unit 30 forms an electrostatic latent image on a photosensitive drum contained in the image drum, and develops the electrostatic latent image with a toner to form a toner image. The toner image on the photosensitive drum 51 developed by the developing unit 30 is transferred to the recording medium by a transfer unit consisting of the transfer belt 24, the transfer belt unit 25, and the transfer roller 60 described below.

The image forming apparatus has a fusing unit 40 for fixing onto the recording paper the toner image formed on the recording paper. The fusing unit 40 has, for example, a heater, a pressure roller, and the like, and fixes the toner image on the recording paper by heat and pressure. Upon the image being fixed onto the recording paper by the fusing unit 40, the image forming apparatus conveys and discharges the recording paper to the outside through the rotation of the rollers 14 and 15 to stack the recording paper on the stacker 22.

Figure 3:
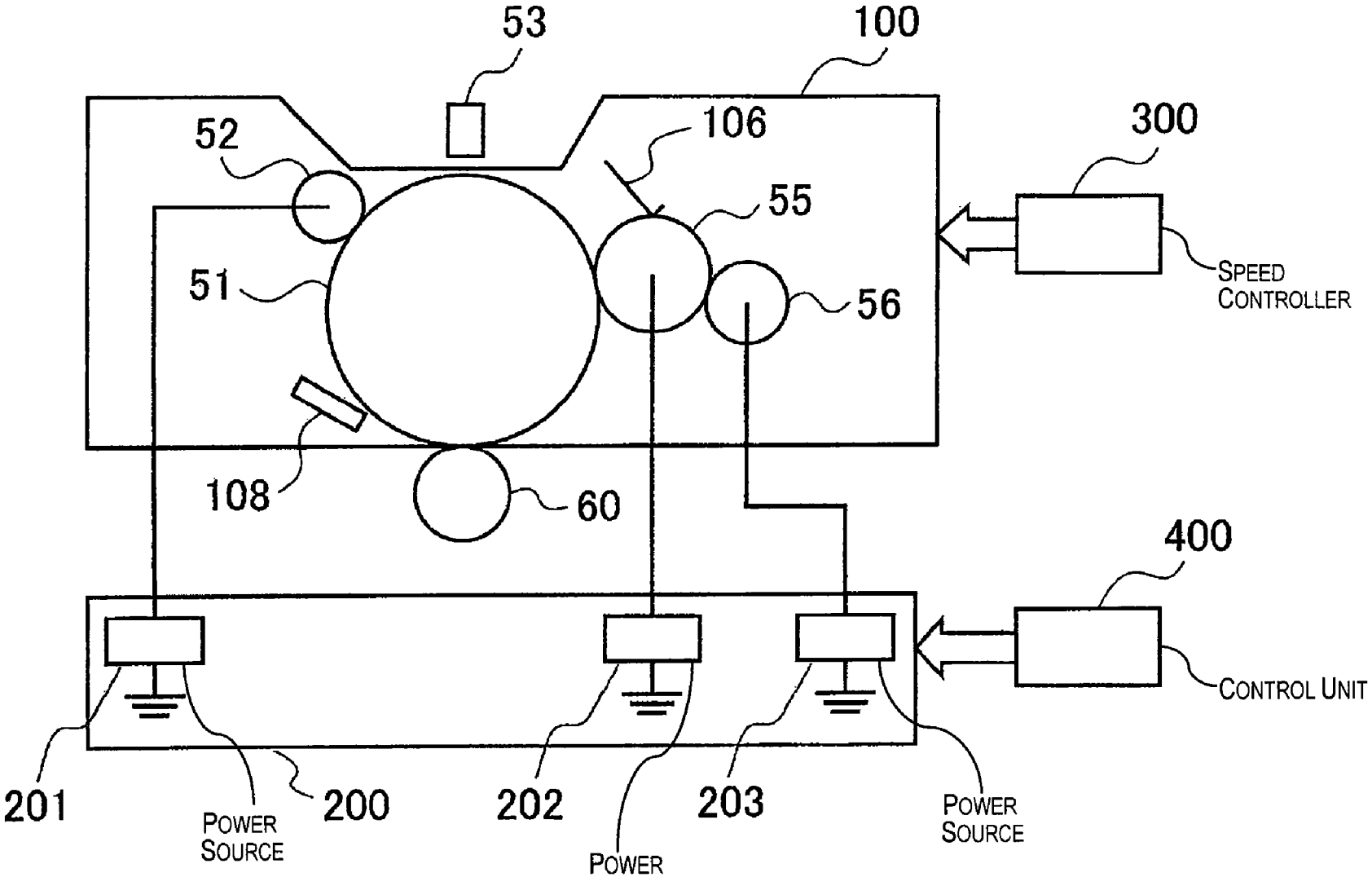
FIG. 3 is a schematic diagram of the ID unit of the image forming apparatus according to the first embodiment of the present invention.

Each of the developing units 30 of the image forming apparatus is structured as shown in FIG. 3 in details. The developing unit 30 has a photosensitive drum 51 as a carrier of the electrostatic latent image consisting of a conductive supporter and photoconductive layers. The photosensitive drum 51 is an organic photosensitive body formed by layering a charge generating layer and a charge transport layer as photoconductive layers on a metal pipe made of aluminum as a conductive supporter. The photosensitive drum 51 is rotatable around the conductive supporter as a central axis at a rotational speed controlled by a speed controller 300. The photosensitive drum 51 can store charges on a surface thereof and can remove the charges on the surface thereof upon being exposed to light by an exposure unit 53 as described below.

A charging roller 52 as a charging member consisting of, for example, a metal shaft and a semiconductive rubber layer for charging the photosensitive drum 51 is arranged on the surface of the photosensitive drum 51. The charging roller 52 is in contact with the surface of the photosensitive drum 51 with a constant pressure, and can rotate around the metal shaft as a central axis in the same direction as a direction of rotation of the photosensitive drum 51. A prescribed positive or negative voltage is applied to the charging roller 52 from a power source 201 as a voltage application unit for the charging member, so that the prescribed positive or negative voltage is applied to the photosensitive drum 51 to charge the photosensitive drum 51.

The exposure unit 53 for forming the electrostatic latent image on the surface of the photosensitive drum 51 is arranged above the photosensitive drum 51. The exposure unit 53 irradiates light corresponding to an image signal onto the surface of the photosensitive drum 51 to form the electrostatic latent image thereon. The exposure unit 53 is made of, for example, a combination of an LED (Light Emitting Diode) array and a Lens Array, a combination of a laser and an imagery optical system, and the like.

A developing roller 55 as a developing member is arranged around the photosensitive drum 51, and the developing roller 55 consists of, for example, a metal shaft and a semiconductive urethane rubber material and develops the electrostatic latent image formed on the photosensitive drum 51 with the toner. The developing roller 55 is in contact with the photosensitive drum 51 with a constant pressure, and can rotate around the metal shaft as a central axis in a direction opposite to the direction of rotation of the photosensitive drum 51. A prescribed positive or negative voltage is applied to the developing roller 55 from a power source 202 as a voltage application unit for the developing member, so that the developing roller 55 develops with the toner the electrostatic latent image formed by the exposure unit 53 on the photosensitive drum 51 in contact with the developing roller 55.

The developing roller 55 has a supply roller 56 as a supplying member for supplying the toner contained in a toner container 54 to the developing roller 55. The supply roller 56 is in contact with the developing roller 55 with a constant pressure, and can rotate around an axis in the same direction as the direction of rotation of the developing roller 55. A prescribed positive or negative voltage is applied to the supply roller 56 from a power source 203 as a voltage application unit for the supplying member, and thereby, the toner attached to the supply roller 56 is charged and supplied to the developing roller 55 in contact with the supply roller 56.

The developing roller 55 has a doctor blade 106 for regulating a thickness of the toner supplied by the supply roller 56 to the developing roller 55 to a constant thickness. The doctor blade 106 is made of a thin plate, for example, of a thickness of 0.08 mm, and a longitudinal length of the plate is substantially the same as a width of the developing roller 55. The doctor blade 106 is bent at a portion near a longitudinal side of the plate substantially in a shape of L, and the portion bent in the shape of L is in contact with the developing roller 55 with a constant pressure. The other longitudinal side thereof is fixed to a frame, not shown.

A cleaning device 108 made of a prescribed elastic body is arranged around the photosensitive drum 51. One end of the cleaning device 108 is in contact with the surface of the photosensitive drum 51 with a constant pressure to scrape off the toner remained on the surface of the photosensitive drum 51.

The developing unit 30 thus structured develops the electrostatic latent image formed on the photosensitive drum 51. The above-described transfer belt 24 as well as the transfer roller 60 for transferring the toner image onto the recording paper are arranged below the photosensitive drum 51 of the developing unit 30. The transfer roller 60 is in contact with a back surface of the transfer belt 24, and a prescribed positive or negative voltage is applied to the transfer roller 60 while the transfer roller 60 and the photosensitive drum 51 sandwich the recording paper placed on the transfer belt 24, so that the toner is transferred to the recording paper.

An image drum unit (hereinafter referred to as an ID unit) 100 consists of the photosensitive drum 51, the charging roller 52, the developing roller 55, the supply roller 56, the doctor blade 106, and the cleaning device 108 of the developing unit 30. A speed control unit 300 controls the driving of the photosensitive drum 51, the charging roller 52, the developing roller 55, and the supply roller 56 of the ID unit 100 to prescribed rotational speeds of respective drum and rollers.

The power source 201 for applying the prescribed positive or negative voltage to the charging roller 52, the power source 202 for applying the prescribed positive or negative voltage to the developing roller 55, and the power source 203 for applying the prescribed positive or negative voltage to the supply roller 56 are connected to a voltage application control unit 400. The voltage application control unit 400 controls the power source 201 to apply a voltage of the same polarity as the toner to the charging roller 52. The voltage application control unit 400 controls the power source 202 to apply a voltage of the same polarity as the toner to the developing roller 55. The voltage application control unit 400 controls the power source 203 to apply a voltage of the same polarity as the toner to the supply roller 56.

An image forming apparatus structured as described above and made according to the first embodiment of the invention is hereinafter described.

The image forming apparatus according to the first embodiment of the invention develops the electrostatic latent image formed on the photosensitive drum 51 so as to form an image to be transferred to the recording paper as described above. Then, the image forming apparatus transfers the toner image formed on the photosensitive drum 51 onto the recording paper, and forms the image on the recording paper by fixing the transferred toner image.

When the photosensitive drum 51, the charging roller 52, the developing roller 55, and the supply roller 56 are rotationally driven by the control of the speed control unit 300, the voltage application control unit 400 controls the power source 201 connected to the charging roller 52 to apply a prescribed voltage of the same polarity as the toner to the charging roller 52. Thus, the voltage of the same polarity as the toner from the power source 201 charges the charging roller 52, and the photosensitive drum 51 in contact with the charging roller 52 rotates in the same direction as the rotation of the charging roller 52, so that the surface of the photosensitive drum 51 is charged to the same polarity as the toner.

Subsequently, the exposure unit 53 irradiates, for example, LED light, laser light, and the like to the photosensitive drum 51 based on the image data output from a writing control unit, not shown, to form the electrostatic latent image in accordance with the image data on the surface of the photosensitive drum 51.

The voltage application control unit 400 controls the power source 203 connected to the supply roller 56 to apply a voltage of the same polarity as the toner to the supply roller. Thus, the voltage applied from the power source 203 charges the supply roller 56, and the supply roller 56 supplies the toner to the developing roller 55 in contact with the supply roller by the rotation of the supply roller 56.

The developing roller 55 having been supplied with the toner by the supply roller 56 rotates to form a layer of the toner on the surface of the developing roller 55 with the help of the doctor blade 106 in contact with the developing roller 55. A thickness of the layer of the toner formed on the developing roller 55 is determined by a pressure of the doctor blade 106 opposing the developing roller 55. When the layer of the toner is formed, the toner on the developing roller 55 rubs against the doctor blade 106, and this rubbing charges the toner.

When a voltage is applied to the supply roller 56, the voltage application control unit 400 controls the power source 202 connected to the developing roller 55 to apply a voltage of the same polarity as the toner to the developing roller 55 to develop the electrostatic latent image formed on the photosensitive drum 51. Then, the voltage from the power source 202 charges the developing roller 55 to the same polarity as the toner, and the rotation of the developing roller 55 causes the charged toner to attach onto the photosensitive drum 51 having the electrostatic latent image formed thereon. The toner attaching thereto makes the electrostatic latent image the visible toner image.

After the toner image is formed, a voltage of a polarity opposite to the toner is applied to the transfer roller 60 from a power source, not shown, so that the toner image is transferred to the conveyed recording paper. After the transfer of the toner image, the toner on the photosensitive drum 51 is removed by the cleaning device 108. The transferred toner image is fixed to the recording paper by the fusing unit 40, and the recording paper is discharged to the stacker 22.

Figure 1:
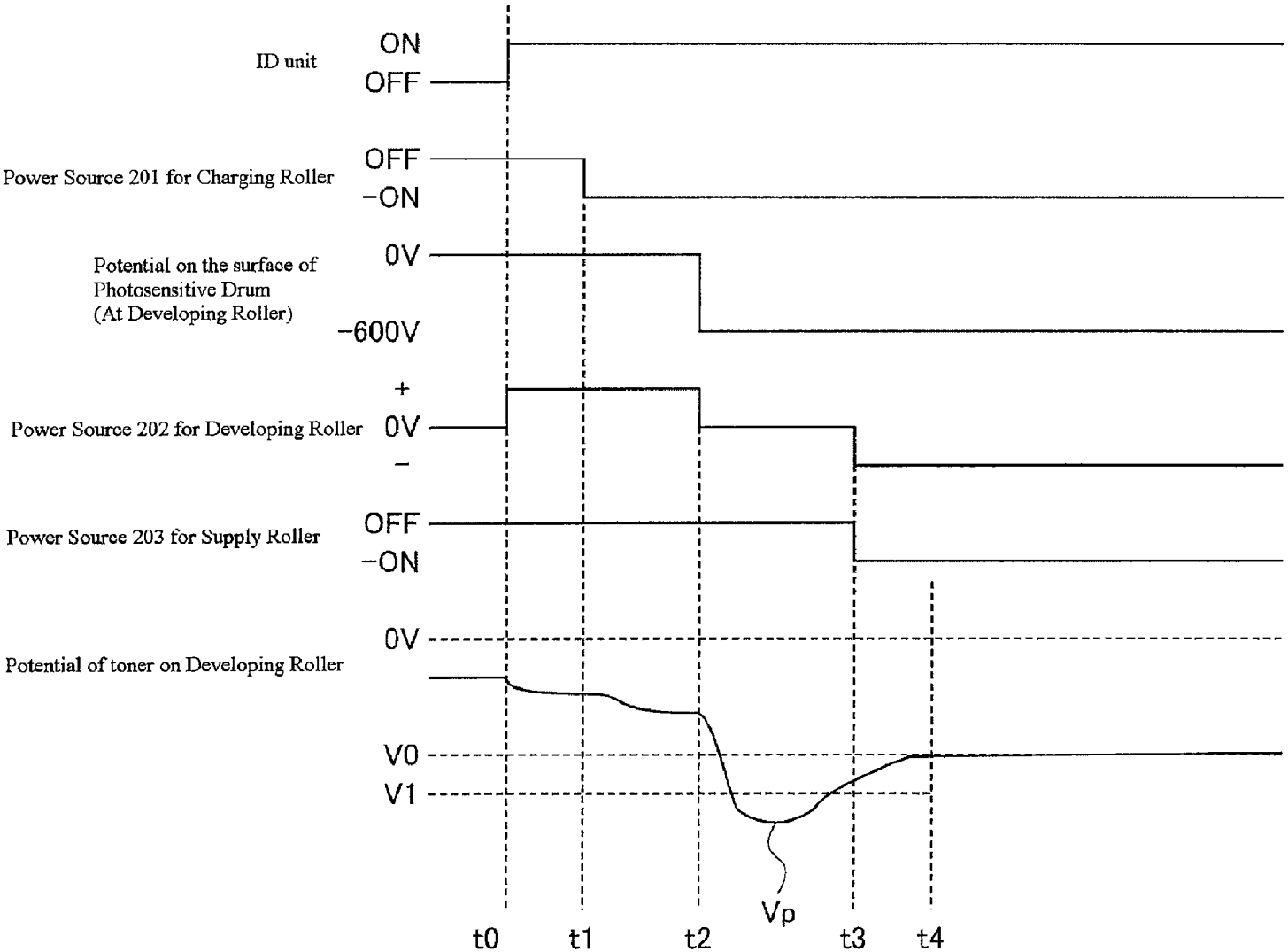
FIG. 1 is a timing diagram of the image forming apparatus according to the first embodiment of the present invention.
Figure 4:
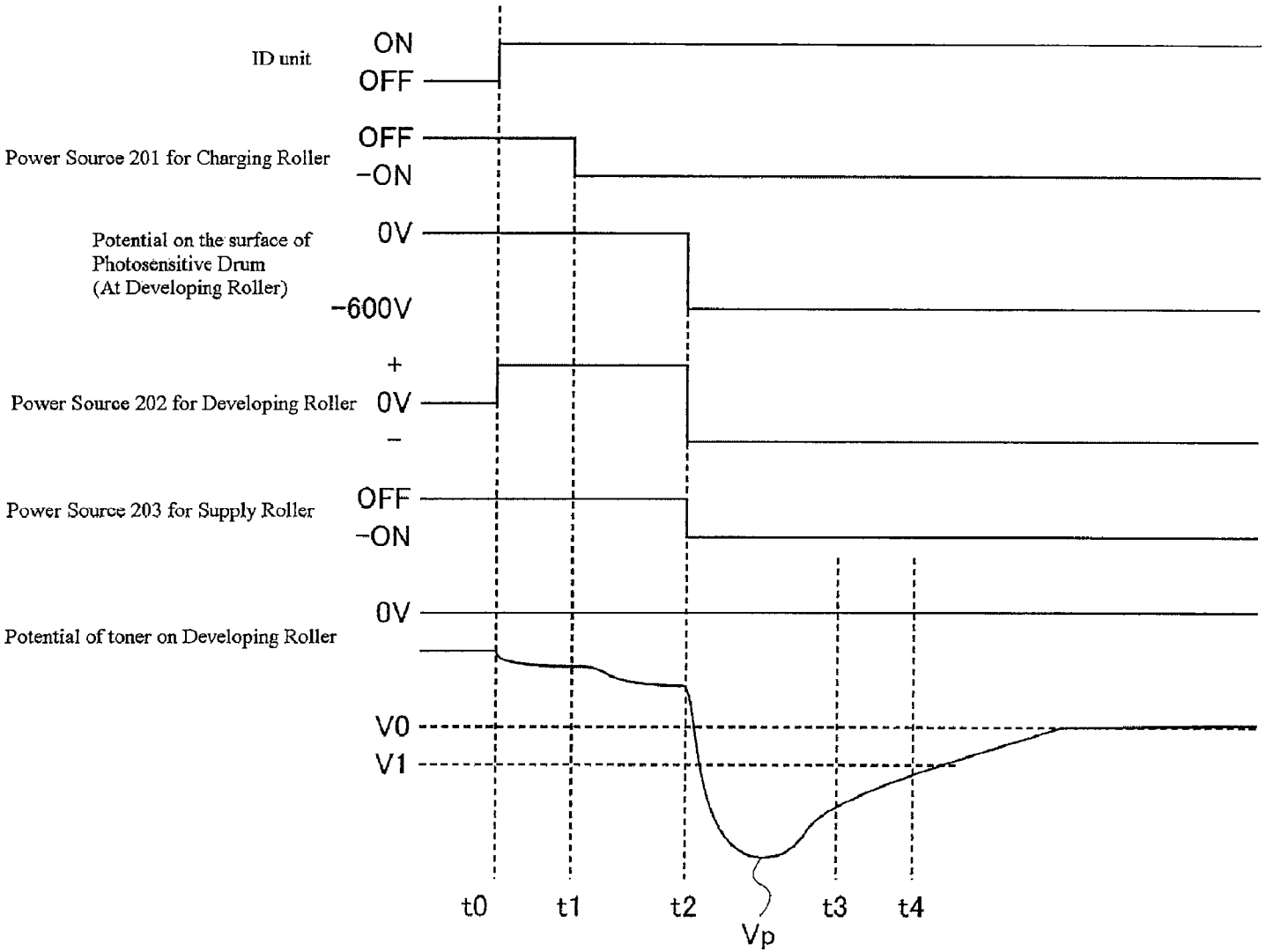
FIG. 4 is a timing diagram of the conventional image forming apparatus described in the first embodiment.

The image forming apparatus thus forming the image is described with reference to FIG. 1 and FIG. 4. FIG. 1 is a timing diagram of the image forming apparatus according to the first embodiment of the invention and shows timings of voltage application of the ID unit and respective power sources, a profile of charge potential of the photosensitive drum at a location in contact with the developing roller, and a profile of charge potential of the developing roller. FIG. 4 is a timing diagram of a conventional image forming apparatus and shows the same as FIG. 1.

As shown in FIG. 4, the conventional image forming apparatus has the speed control unit 300 control and drive the ID unit 100 at a time t0 to drive the photosensitive drum 51, the charging roller 52, the developing roller 55, and the supply roller 56. Simultaneously with the driving of the ID unit 100, the voltage application control unit 400 controls the power source 202 to apply a voltage of a polarity opposite to the toner (for example +300V) to the developing roller 55.

This is done due to the existence of an area (uncharged area) on the photosensitive drum 51 not having been charged by the charging roller 52 immediately after the start of the ID unit. The voltage application control unit 400 controls the power source 202 to apply the voltage of the polarity opposite to the toner to the developing roller 55 in order to prevent the toner from attaching to the uncharged area. The voltage of the polarity opposite to the toner is applied to the developing roller 55, so that the toner is attracted to the developing roller 55 and does not attach to the uncharged area of the photosensitive drum 51.

The voltage application control unit 400 controls the power source 201 not to apply a voltage to the charging roller 52 at the time t0 and controls the power source 202 not to apply a voltage to the supply roller 56.

The voltage application control unit 400 controls the power source 201 to apply a voltage of the same polarity as the toner (for example −1100V) to the charging roller 52 at a time t1 when the ID unit 100 operates stably.

At a time t2 when a portion of the photosensitive drum 51 having been contacted and charged by the charging roller 52 reaches the developing roller 55 along with the rotation of the photosensitive drum 51, a voltage of the photosensitive drum 51 at the developing roller 55 increases as shown in FIG. 4. At the time t2, the voltage application control unit 400 controls the power source 202 to apply a voltage of the same polarity as the toner to the developing roller 55 in order to begin to develop a charged area of the photosensitive drum 51. In addition, the voltage application control unit 400 controls the power source 203 to apply a voltage of the same polarity as the toner to the supply roller 56.

At the time t2, the power source 202 connected to the developing roller 55 is switched to apply a voltage of the same polarity as the toner, and the power source 203 connected to the supply roller applies a voltage of the same polarity as the toner, so that the amount of the toner attached to the developing roller 55 increases. Therefore, a maximum value Vp of the potential of the toner on the developing roller 55 increases as shown in FIG. 4. However, as the developing roller 55 rotates, the amount of the toner attached to the developing roller 55 decreases, and the increased potential of the toner on the developing roller decreases to become a stable potential of 0 V, but printing on the recording paper begins at a time t4 even though a toner potential V1 on the developing roller 55 is still high. Where printing on the recording paper begins while the toner potential is still high, some of the toner on the developing roller 55 adversely moves to the photosensitive drum 51 irrespectively of the electrostatic latent image formed thereon and attaches to the recording paper, thereby smearing the recording paper.

The image forming apparatus according to the first embodiment of the invention is made to solve the above problem. Specifically, the image forming apparatus controls and drives the ID unit 100 at the time t0 as shown in FIG. 1 to rotate the photosensitive drum 51, the charging roller 52, the developing roller 55, and the supply roller 56. Simultaneously with the start of the ID unit, the voltage application control unit 400 controls the power source 202 to apply a voltage opposite to the toner (for example +300V) to the developing roller 55. Furthermore, the voltage application control unit 400 controls the power source 201 not to apply a voltage to the charging roller 52, and controls the power source 203 not to apply a voltage to the supply roller 56.

At the time t1 when the ID unit operates stably, the voltage application control unit 400 controls the power source 201 to apply a voltage of the same polarity as the toner (for example −100V) to the charging roller 52.

At the time t2 when a portion of the photosensitive drum 51 having been contacted and charged by the charging roller 52 reaches the developing roller 55 along with the rotation of the photosensitive drum 51, a voltage of the photosensitive drum 51 at the developing roller 55 increases as shown in FIG. 1. At the time t2, the voltage application control unit 400 controls the power source 202 to apply to the developing roller 55 a voltage equal to or less than a difference between a voltage applied by the power source 202 to the developing roller 55 during printing and a voltage applied by the power source 203 to the supply roller 56 during printing. For example, as shown in FIG. 1, the power source 202 has been applying the voltage of +300V to the developing roller 55 until the time t2, and the voltage application control unit 400 controls the power source 202 to apply a voltage of 0V to the developing roller from the time t2. Furthermore, the voltage application control unit 400 controls the power source 203 not to apply a voltage of the same polarity as the toner to the supply roller 56.

In a case of the conventional image forming apparatus of FIG. 4, where the voltage of the polarity opposite to the toner is applied to the supply roller at the time t2 from the power source 203 connected to the supply roller, the maximum value Vp of the potential of the toner on the developing roller 55 adversely increases. On the other hand, the image forming apparatus of the present invention controls the power source 202 to apply to the developing roller 55 a voltage (for example 0V) equal to or less than a difference between a voltage applied by the power source 202 to the developing roller 55 during printing and a voltage applied by the power source 203 to the supply roller 56 during printing, so that the potential of the toner increases less and the maximum value Vp of the potential of the toner on the developing roller 55 becomes less than that of the conventional image forming apparatus as shown in FIG. 1.

At a time t3 when the voltage application control unit 400 controls the power source 203 to apply a voltage (for example −350V) to the supply roller, the voltage application control unit 400 controls the power supply 202 to apply to the developing roller a voltage (for example −200V) for printing that is more than the voltage applied to the developing roller during a period between t2 and t3, so that the charged area on the photosensitive drum 51 begins to be developed. Although the voltages applied to the developing roller and the supply roller are changed, the potential of the toner on the developing roller of the present invention does not greatly increase as much as that of the conventional image forming apparatus of FIG. 4, that is, the potential of the toner on the developing roller of the image forming apparatus of the present invention increases less than that of the conventional image forming apparatus.

At the time t4 from which printing on the recording paper begins, the potential of the toner on the developing roller 55 becomes lower than the toner potential V1 and becomes closer to a stable potential V0. Therefore, the image forming apparatus of the present invention prevents any of the toner from moving to the photosensitive drum 51 irrespectively of the electrostatic latent image and prevents a smear of the recording paper.

Figure 5:
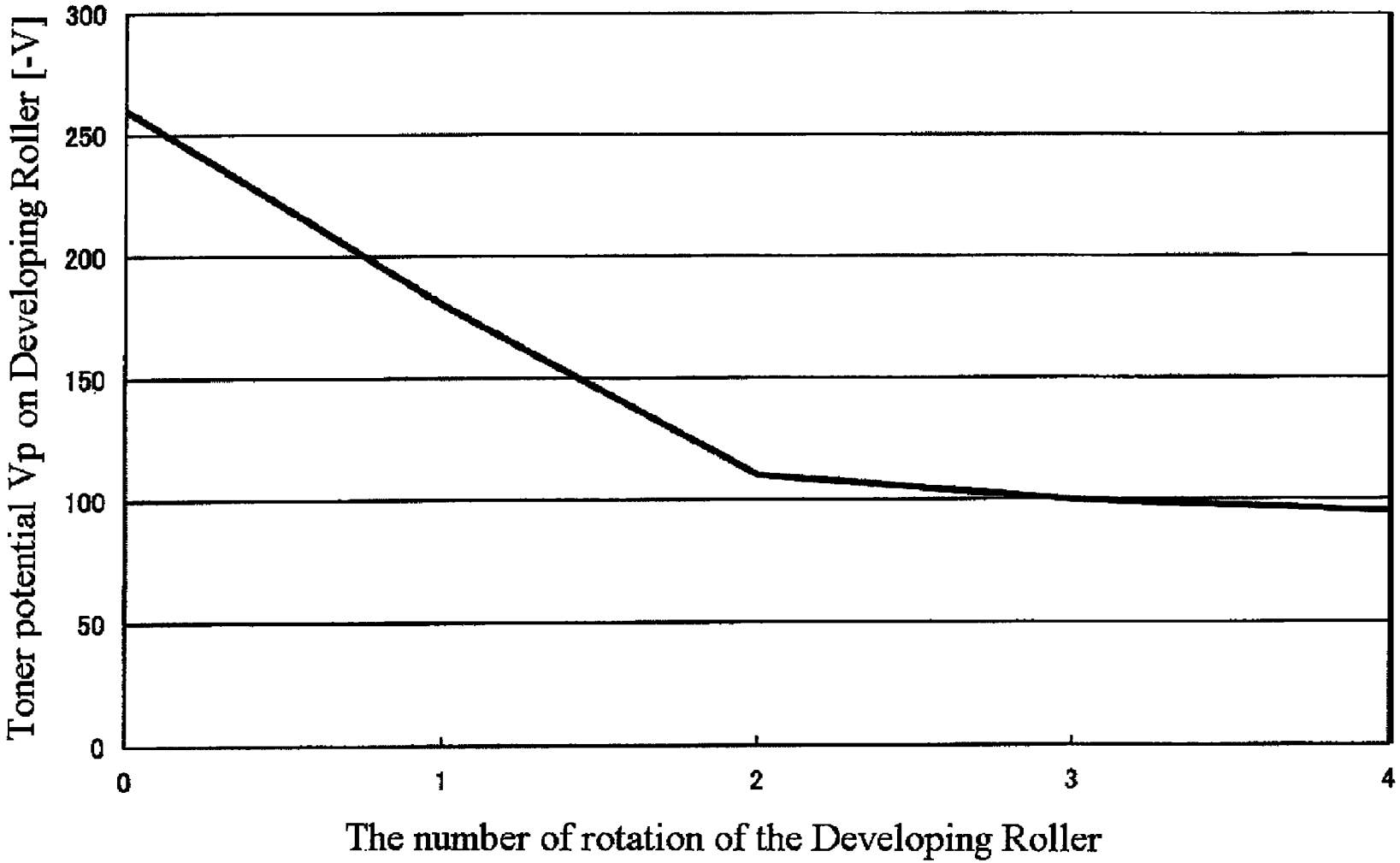
FIG. 5 is a graph showing relationship between the number of rotation of the developing roller and the toner potential of the image forming apparatus according to the first embodiment of the present invention.

Hereinafter described with reference to FIG. 5 is a period in which the voltage application control unit 400 controls the power source 202 to apply to the developing roller 55 a voltage equal to or less than a difference between a voltage applied by the power source 202 to the developing roller 55 during printing and a voltage applied by the power source 203 to the supply roller 56 during printing, namely, a period from t2 to t3. FIG. 5 shows a profile of the potential of the toner on the developing roller versus the number of rotation of the developing roller when the voltage application control unit controls the voltage applied to the developing roller to be 0V. The ordinate of FIG. 5 shows a duration of the period from t2 to t3, during which period 0V is applied to the developing roller, expressed by the number of rotation of the developing roller. The abscissa of FIG. 5 shows the potential of the toner on the developing roller.

Where the power source 202 applies the voltage of 0V to the developing roller 55 for the period in which the developing roller rotates 0 time, the potential of the toner on the developing roller 55 exceeds −250V, and the paper is smeared in this case. As the period in which the power source 202 applies the voltage of 0V to the developing roller 55 gradually becomes longer, the potential of the toner on the developing roller 55 decreases. Where the developing roller 55 rotates twice, the potential of the toner on the developing roller 55 becomes −110V. Where the developing roller 55 rotates three times or more, the potential of the toner on the developing roller 55 is stabilized.

Based on the above result, the power source 202 is configured to apply the voltage of 0V to the developing roller 55 for the period in which the developing roller 55 rotates at least three times or more after the portion of the photosensitive drum 51 having been contacted and charged by the charging roller 52 reaches the developing roller 55. The voltage applied to the developing roller 55 during this period should not be necessarily 0V but should be equal to or less than a difference between a voltage applied to the developing roller 55 during printing and a voltage applied to the supply roller 56 during printing. After the developing roller 55 rotates at least three times or more, the voltage application control unit 400 controls the power source 203 to apply a voltage of the same polarity as the toner to the supply roller 56. The voltage application control unit 400 controls the power sources 202 and 203 as described above to stabilize the potential of the toner on the developing roller 55, thus preventing the recording paper from being smeared.

In the first embodiment of the invention, the voltage application control unit 400 controls the voltage applied to the developing roller 55 to be 0V. However, the voltage should only be equal to or less than a difference between a voltage applied to the developing roller 55 during printing and a voltage applied to the supply roller 56 during printing. For example, where the voltage of −200V is applied to the developing roller 55 during printing and the voltage of −350V is applied to the supply roller 56 during printing, the same effect can be obtained as long as the voltage is 150V or less.

The image forming apparatus according to the first embodiment of this invention has the voltage application control unit 400 control the power source 202 to apply to the developing roller 55 a voltage equal to or less than a difference between a voltage applied by the power source 202 to the developing roller 55 during printing and a voltage applied by the power source 203 to the supply roller 56 during printing, thereby suppressing the increase of the potential of the toner on the developing roller 55. Thus, the image forming apparatus prevents the toner from moving to the photosensitive drum 51 irrespectively of the electrostatic latent image, and also prevents the recording paper from being smeared.

Second Embodiment

The image forming apparatus according to the second embodiment of this invention has the same structure as that according to the first embodiment, but the apparatus of the second embodiment changes rotational speeds of the photosensitive drum 51, the charging roller 52, the developing roller 55, and the supply roller 56 of the ID unit 100 to suppress the increase of the potential of the toner on the developing roller 55. The image forming apparatus according to the second embodiment is describe hereinbelow with reference to FIG. 6 to FIG. 8.

Figure 6:
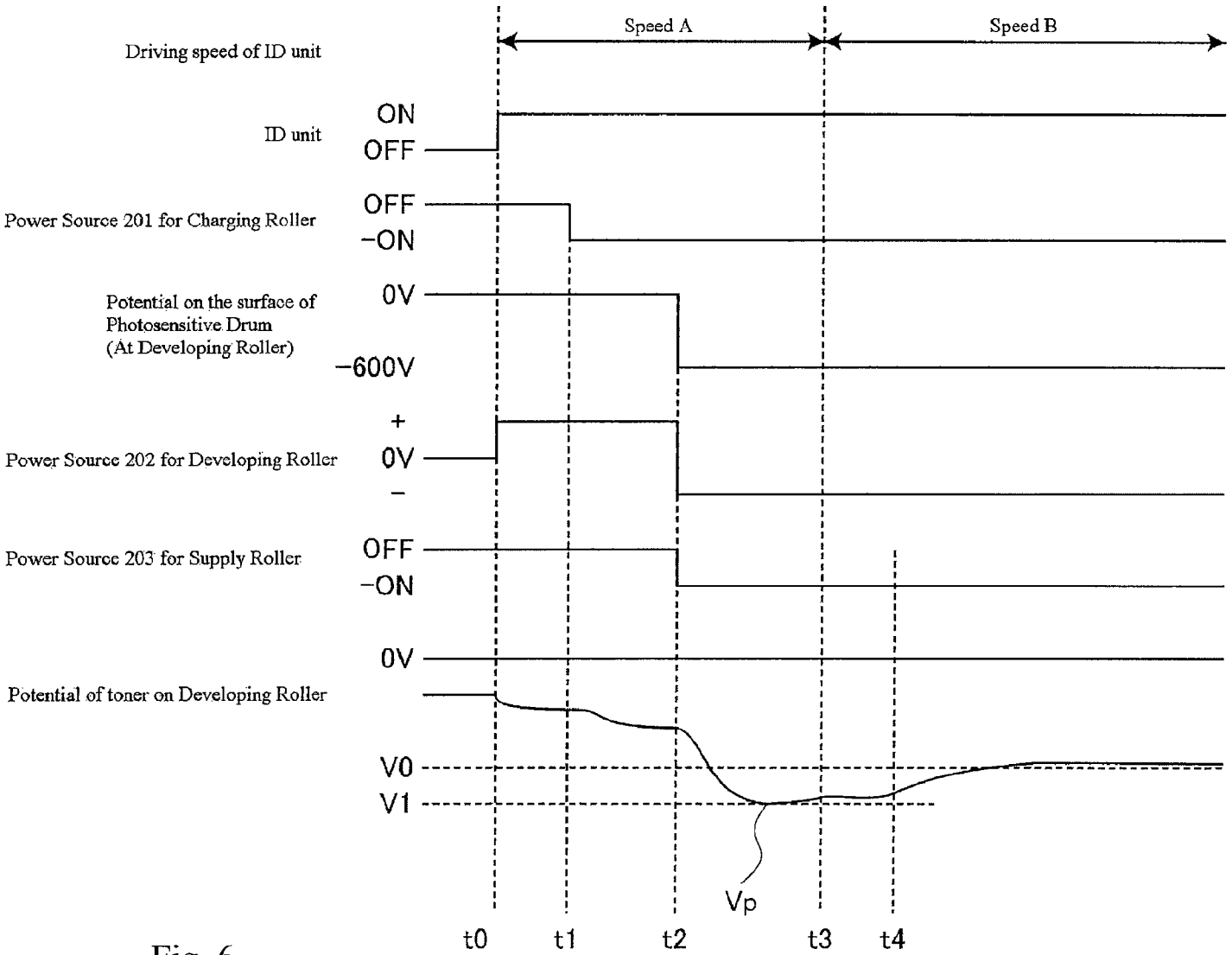
FIG. 6 is a timing diagram of the image forming apparatus according to the second embodiment of the present invention.

FIG. 6 is a timing diagram showing the timing of driving of the ID unit, the timing of voltage application from each of the power sources of the image forming apparatus, a profile of the charging potential of the photosensitive drum at the location in contact with the developing roller, a profile of the potential of the toner on the developing roller, and the driving speed of the ID unit.

At the time t0, the image forming apparatus according to the second embodiment of the invention has the speed control unit 300 drive the ID unit 100 to rotate the photosensitive drum 51, the charging roller 52, the developing roller 55, and the supply roller 56 at a speed A (for example 12 PPM) which is slower than a normal speed for printing. Simultaneously with the driving of the ID unit 100, the voltage application control unit 400 controls the power source 202 to apply a voltage of a polarity opposite to the toner (for example +300V) to the developing roller 55. The voltage application control unit 400 controls the power source 201 not to apply a voltage to the charging roller 52, and controls the power source 203 not to apply a voltage to the supply roller 56.

At the time t1 when the ID unit 100 drives stably, the voltage application control unit 400 controls the power source 201 to apply a voltage of the same polarity as the toner (for example −1100V) to the charging roller 52.

At the time t2 when a portion of the photosensitive drum 51 having been contacted and charged by the charging roller 52 reaches the developing roller 55 along with the rotation of the photosensitive drum 51, a voltage of the photosensitive drum 51 at the developing roller 55 increases as shown in FIG. 6. At the time t2, the voltage application control unit 400 controls the power source 202 to apply a voltage of the same polarity as the toner to the developing roller 55 in order to begin to develop the charged area of the photosensitive drum 51. In addition, the voltage application control unit 400 controls the power source 203 to apply a voltage of the same polarity as the toner to the supply roller 56.

At the time t2, the power source 202 connected to the developing roller 55 is switched to apply a voltage of the same polarity as the toner, and the power source 203 connected to the supply roller applies a voltage of the same polarity as the toner, so that the amount of the toner attached to the developing roller 55 increases and the potential of the toner on the developing roller 55 begins to increase.

At the time t3, the speed control unit 300 controls the photosensitive drum 51, the charging roller 52, the developing roller 55, and the supply roller 56 of the ID unit 100 to change the driving speeds thereof to a speed B which is faster than the speed A and is the normal speed for printing. Thus, the potential of the toner on the developing roller 55 is prevented from increasing, and at the time t4 from which printing on the recording paper begins, the potential of the toner on the developing roller 55 becomes smaller than the potential V1 and becomes closer to the stable potential V0. Therefore, as shown in FIG. 4, any of the toner is prevented from moving to the photosensitive drum 51 irrespectively of the electrostatic latent image, and the recording paper is not smeared.

Figure 7:
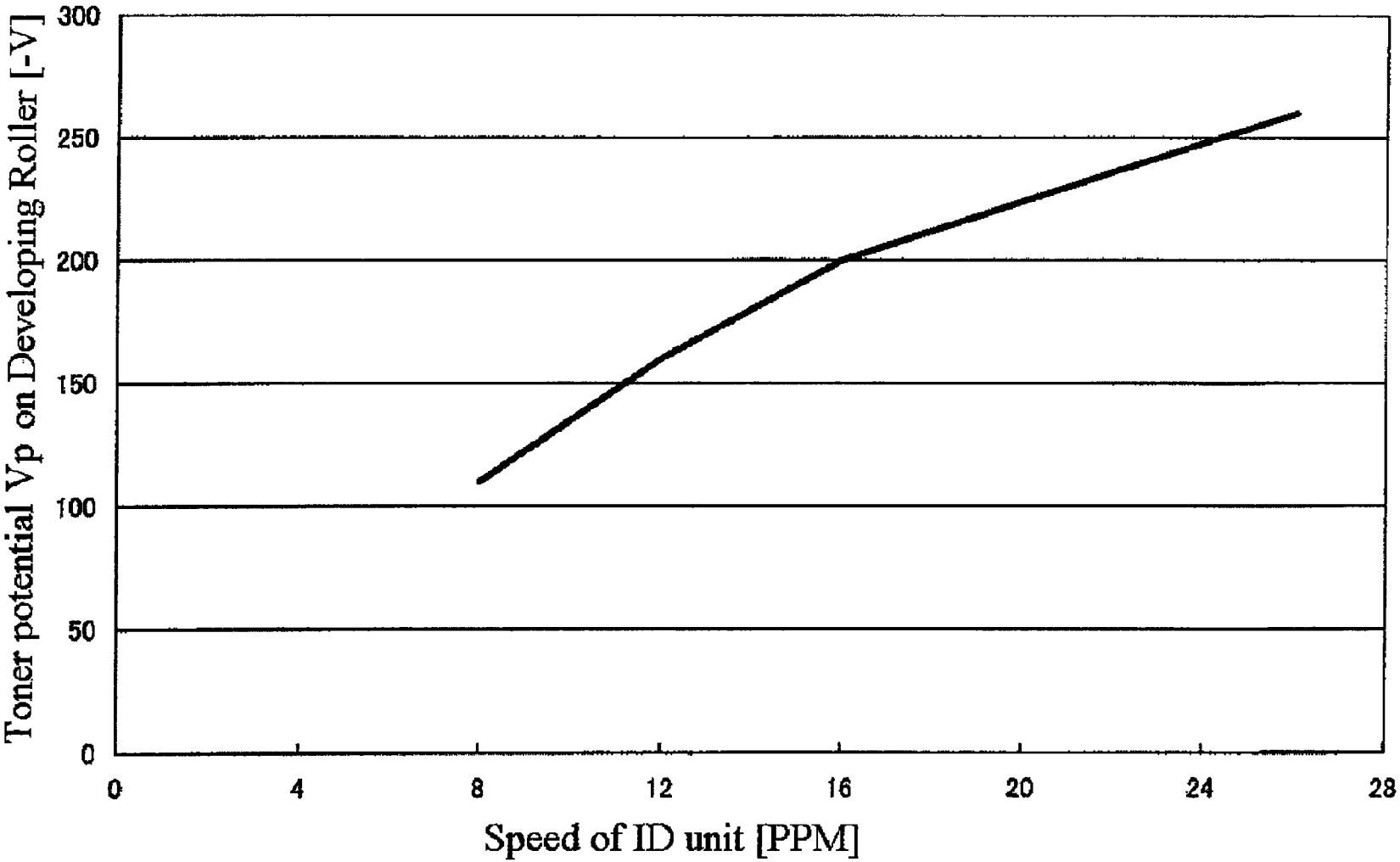
FIG. 7 is a graph showing relationship between the printing speed and the toner potential of the image forming apparatus according to the second embodiment of the present invention.
Figure 8:
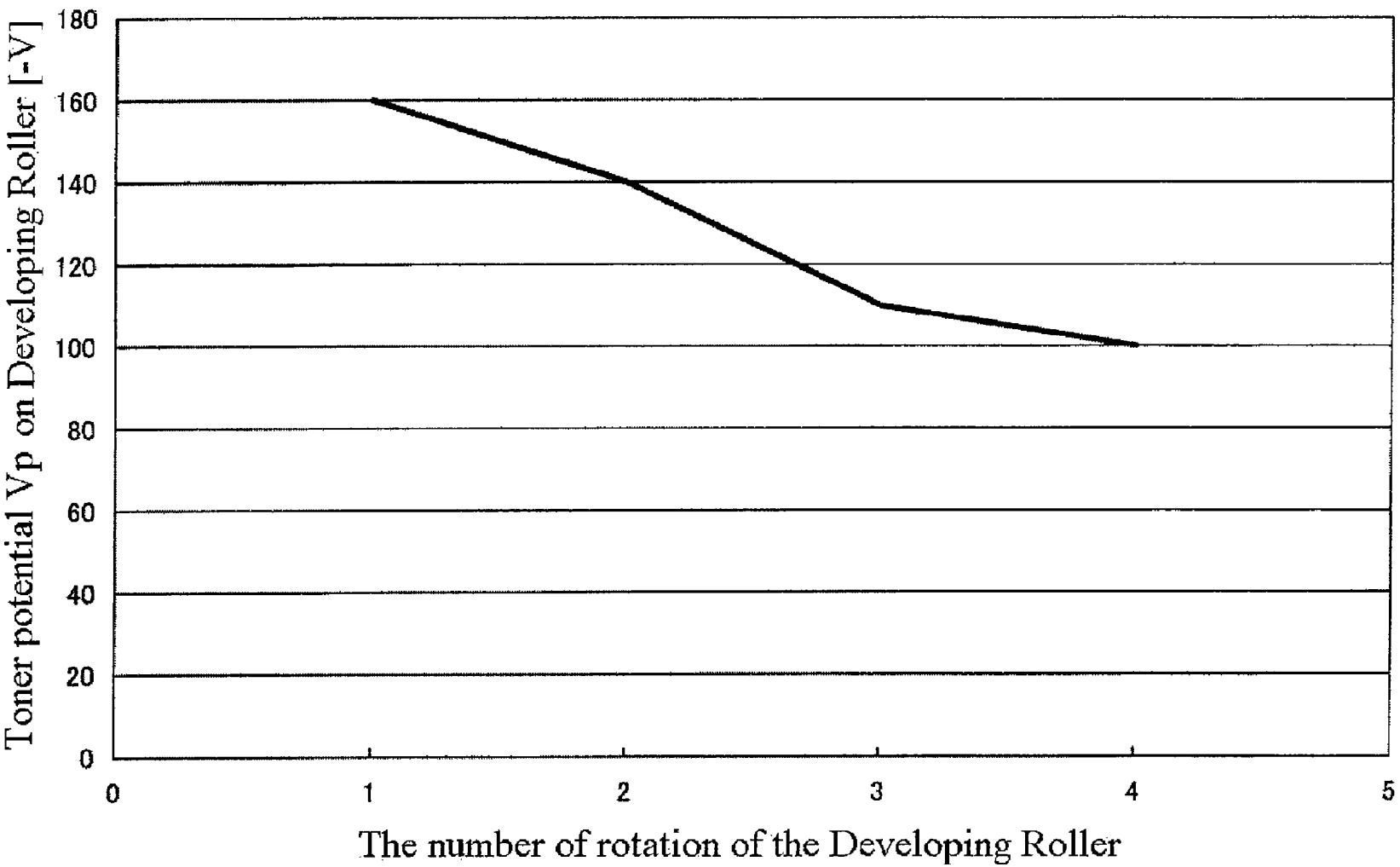
FIG. 8 is a graph showing relationship between the number of rotation of the developing roller and the toner potential of the image forming apparatus according to the second embodiment of the present invention.

Hereinafter described with reference to FIGS. 7 and 8 are a period in which the speed control unit 300 has the ID unit 100 drive at a different speed and the driving speed in that period. FIG. 7 shows a relationship between the maximum potential Vp of the toner on the developing roller and the printing speed. Where the printing speed is 26 PPM, the maximum potential Vp of the toner is −260V. Where printing is performed on the recording paper with this level of toner potential, some of the toner moves to the photosensitive drum 51 irrespectively of the electrostatic latent image and smears the recording paper. As shown in FIG. 7, the maximum potential Vp of the toner becomes smaller as the printing speed becomes slower.

FIG. 8 shows a relationship between the maximum Vp of the potential of the toner on the developing roller and the number of rotation of the developing roller where the printing speed is 12 PPM. As shown in FIG. 8, the more times the developing roller 55 is rotated, the less the potential of the developing roller 55 becomes.

The more times the developing roller 55 is rotated, the less the potential of the toner becomes, but it takes longer until the printing begins. Where the printing speed is 12 PPM, the potential of the toner on the developing roller 55 becomes stable by rotating the developing roller 55 three times or more as shown in FIG. 8. Therefore, the potential of the toner and the waiting time before printing can be compromised where the developing roller 55 is rotated three times in a case of the image forming apparatus according to the second embodiment of the invention.

Based on the above result, the ID unit 100 is configured to change the rotational speed when the developing roller 55 has rotated three times or more after a portion of the photosensitive drum 51 having been contacted and charged by the charging roller 52 reaches the developing roller 55 along with the rotation of the photosensitive drum 51, and the speed control unit 300 controls the driving speed A of the ID unit 100 to be 12 PPM. Therefore, the maximum potential Vp of the toner on the developing roller 55 becomes stable without exceeding the toner potential V1, and the amount of the toner attached to the developing roller 55 becomes stable, thus preventing the recording paper from being smeared.

The image forming apparatus according to the second embodiment of the invention applies a voltage of a polarity opposite to the toner to the developing roller 55, then drives the photosensitive drum 51, the charging roller 52, the developing roller 55, and the supply roller 56 at a speed slower than the normal speed for printing for a prescribed period of time, and subsequently changes the rotational speed to the normal speed for printing after the prescribed period of time has passed. Therefore, the image forming apparatus prevents the potential of the toner on the developing roller 55 from increasing, and prevents any of the toner from moving to the photosensitive drum 51 irrespectively of the electrostatic latent image, thus preventing the recording paper from being smeared.

Third Embodiment

Figure 9:
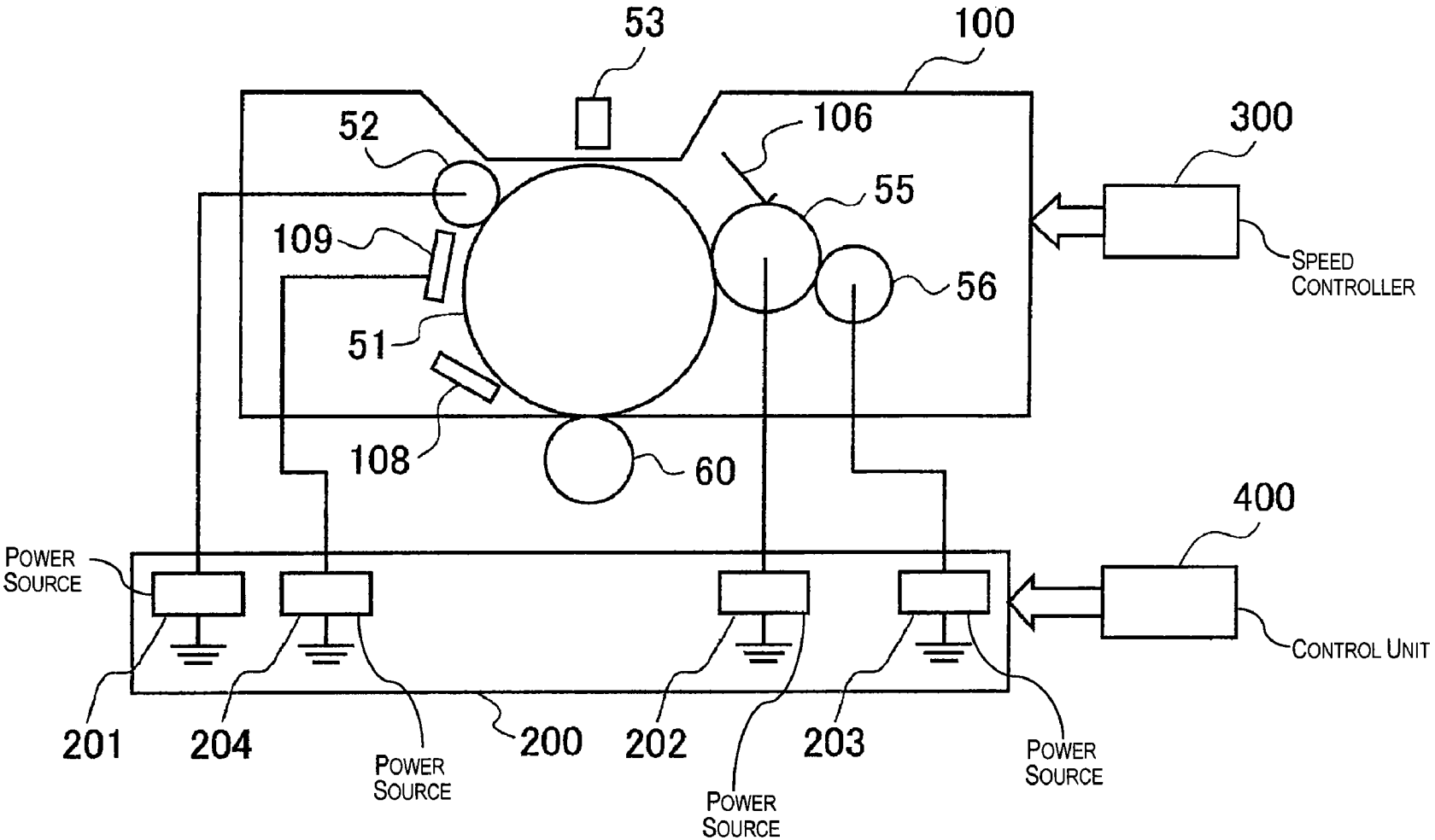
FIG. 9 is a schematic diagram of the ID unit of the image forming apparatus according to the third embodiment of the present invention.

The image forming apparatus according to the third embodiment of the invention has an electrostatic removing unit 109 in addition to the ID unit 100 of the image forming apparatus according to the first embodiment, and prevents the increase of the toner potential that occurs subsequent to a cleaning of the photosensitive drum 51 performed by the cleaning device 108. The image forming apparatus according to the third embodiment is hereinafter described with reference to FIG. 9 to FIG. 11.

The electrostatic removing unit 109 added to the ID unit 100 of the image forming apparatus according to the third embodiment is made of conductive material, and is arranged facing the photosensitive drum 51 without contacting the photosensitive drum 51. A power source 204 as a voltage application unit for the electrostatic removing unit is connected to the electrostatic removing unit 109, and the power source 204 applies an electrostatic removing voltage to the electrostatic removing unit 109 under the control of the voltage application control unit 400 to neutralize the photosensitive drum 51.

Where the apparatus prints on the recording paper many times, the residual toner and silica that the cleaning device 108 fails to remove attach to the charging roller 52 to which a voltage of the same polarity as the toner is applied by the power source 201. Where the voltage of the same polarity as the toner (namely, a negative voltage in this embodiment) is applied to the charging roller, the toner and the silica of the normal polarity (namely, the toner and the silica charged to a negative polarity in this embodiment) do not attach to the charging roller 52, but the toner and the silica of the abnormal polarity (namely, the toner and the silica charged to a positive polarity in this embodiment) attach to the charging roller 52. If a large amount of the toner and the silica of the abnormal polarity attaches to the charging roller 52, charging failure occurs to cause the photosensitive drum 51 to fail to charge normally, thereby causing printing failure.

To prevent the printing failure, the voltage application control unit 400 stops the power source 201 applying a voltage of the same polarity as the toner to the charging roller 52 to allow the charging roller 52 to be cleaned at the end of a print job or during printing. This period is called a cleaning period of the charging roller 52.

Figure 10:
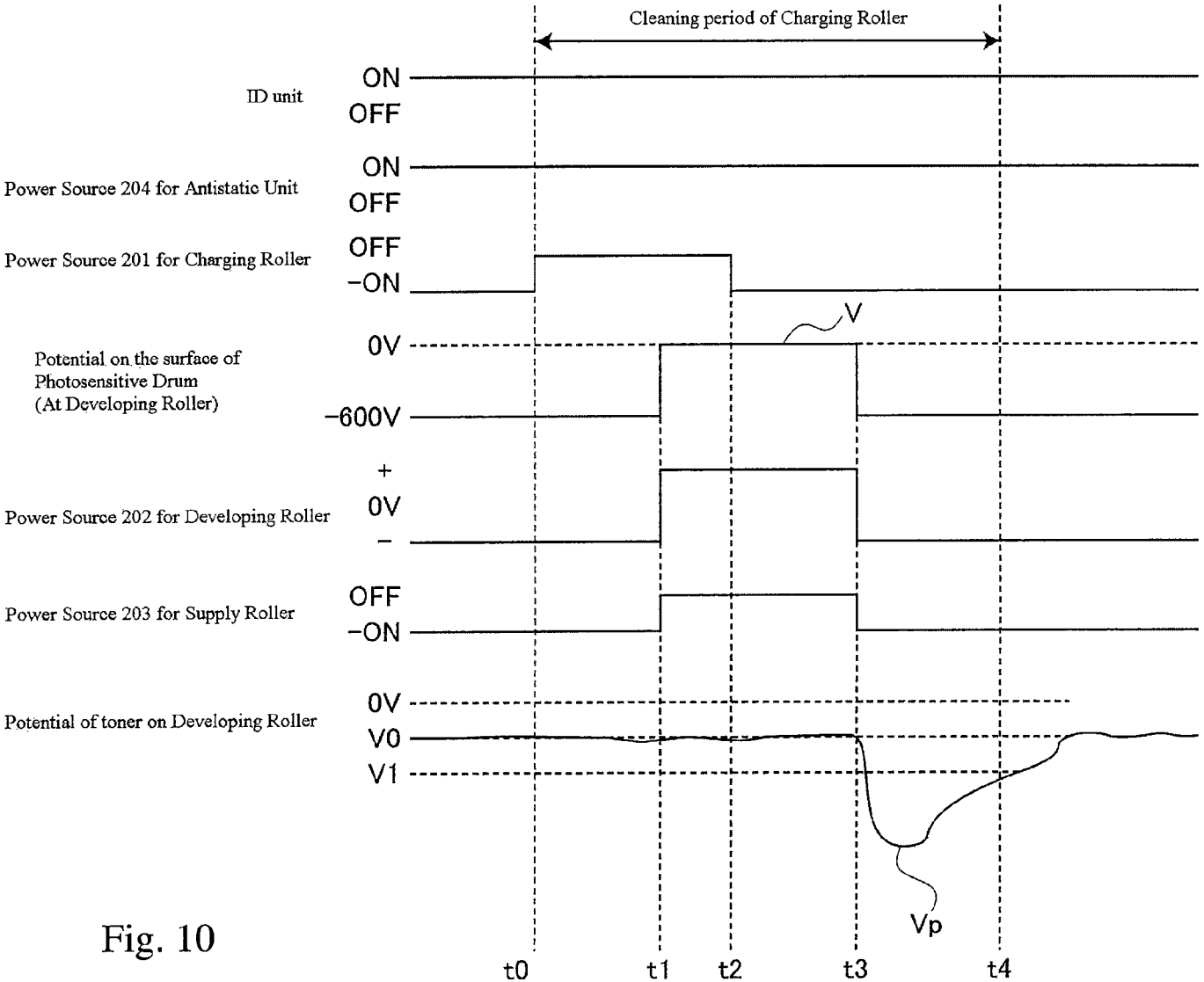
FIG. 10 is a timing diagram of the conventional image forming apparatus described in the third embodiment.
Figure 11:
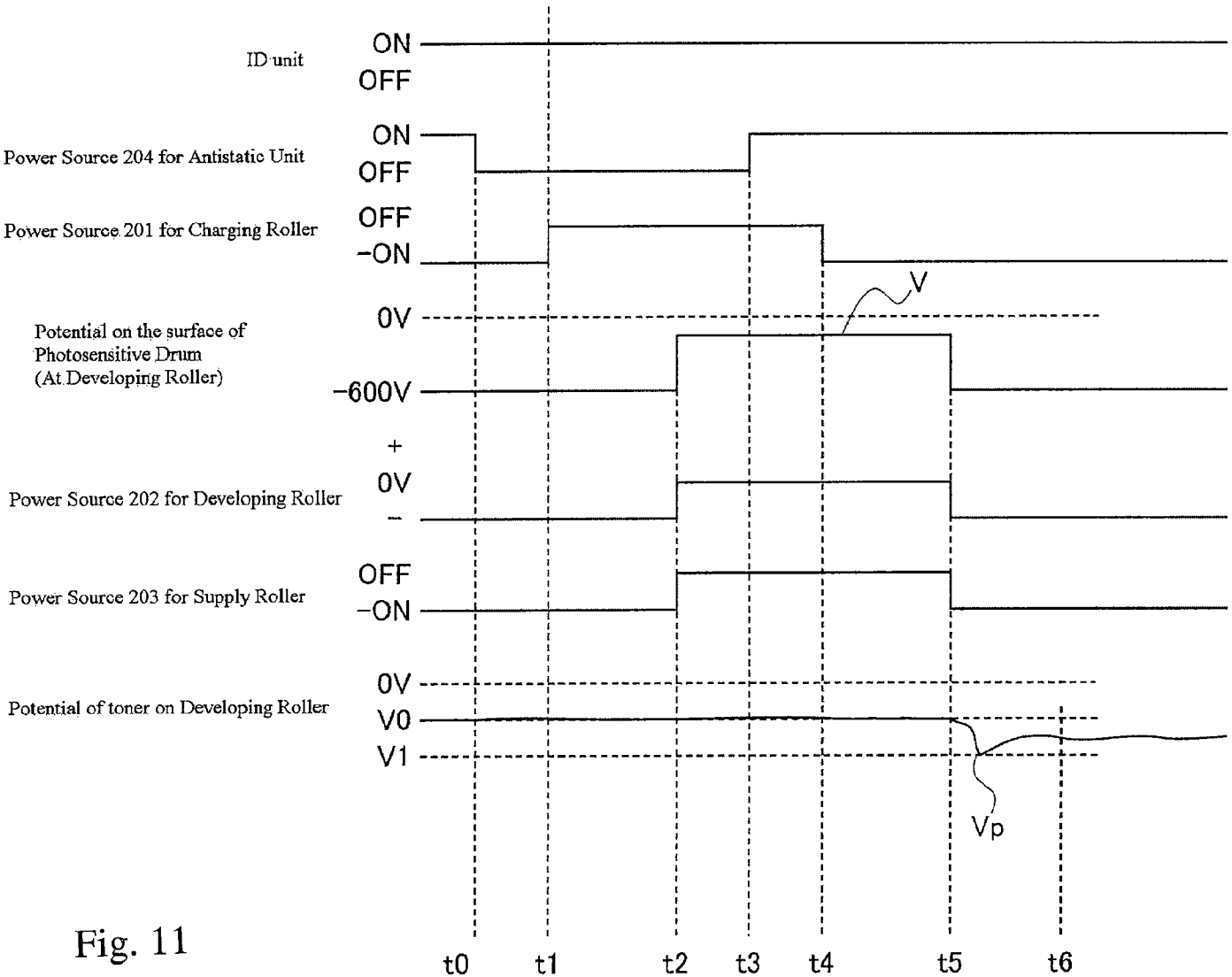
FIG. 11 is a timing diagram of the image forming apparatus according to the third embodiment of the present invention.

The control of each of the power sources 201, 202, 203, and 204 by the voltage application control unit 400 during the cleaning period of the charging roller 52 is hereinafter described with reference to timing diagrams in FIG. 10 and FIG. 11. FIG. 10 is a timing diagram of the charging roller of a conventional image forming apparatus during the cleaning period. FIG. 11 is a timing diagram of the charging roller of the image forming apparatus according to the third embodiment of the invention during the cleaning period.

As shown in FIG. 10, the cleaning period of the charging roller 52 starts from a time t0 at the end of the print job or during printing. At the time t0, the ID unit 100 is driving under the control of the speed control unit 300.

At the time t0 from which the cleaning period starts, the voltage application control unit 400 controls the power source 201 not to apply a voltage of the same polarity as the toner to the charging roller 52. From during printing to the time t0, the voltage application control unit 400 keeps on controlling the power sources 202, 203, and 204 to apply the voltage of the same polarity as the toner to the developing roller 55, the voltage of the same polarity as the toner to the supply roller 56, and the electrostatic removing voltage to the electrostatic removing unit 109.

The voltage applied to the charging roller 52 is stopped, so that the toner and the silica attached to the charging roller 52 that the cleaning device 108 has failed to remove move to the photosensitive drum 51, and thus, the charging roller 52 is cleaned. It is not an electric or electrostatic force that moves the toner and the silica to the photosensitive drum 51, but a mere contact between the charging roller 52 and the photosensitive drum 51 moves the toner and the silica thereto. At this moment, the charging roller does not charge the surface of the photosensitive drum 51 because no charging voltage is applied to the charging roller 52 from the power source 201. The electrostatic removing unit 109 neutralize the photosensitive drum 51, so that the potential of the surface of the photosensitive drum 51 becomes approximately 0V (non-charged).

At a time t1 when the non-charged portion of the photosensitive drum 51 reaches the position of the developing roller 55, the voltage of the photosensitive drum 51 at the developing roller 55 decreases to approximately 0V as shown in FIG. 10. At the time t1, the voltage application control unit 400 controls the power supply 202 to change the voltage applied to the developing roller 55 from a voltage of the same polarity as the toner to a voltage of a polarity opposite to the toner, so that the voltage of the polarity opposite to the toner is applied to the developing roller 55. Furthermore, the voltage application control unit controls the power source 203 applying a voltage of the same polarity as the toner to the supply roller not to apply the voltage to the supply roller 56, so that no voltage is applied to the supply roller 56. Thus, the apparatus prevents the toner from moving to the non-charged surface of the photosensitive drum 51.

At a time t2 when a prescribed time has passed, the voltage application control unit 400 controls the power source 201 to apply the voltage of the same polarity as the toner to the charging roller 52. Thus, the surface of the photosensitive drum 51 is charged.

At a time t3 when a portion of the photosensitive drum 51 having been contacted and charged by the charging roller 52 reaches the developing roller 55 along with the rotation of the photosensitive drum 51, the voltage of the photosensitive drum 51 at the developing roller 55 increases. At the time t3, the voltage application control unit 400 controls the power source 202 to apply the voltage of the same polarity as the toner to the developing roller 55 in order to start developing the charged area of the photosensitive drum 51 again. The voltage application control unit 400 also controls the power source 203 to apply the voltage of the same polarity as the toner to the supply roller 56.

At the time t3, the maximum Vp of the potential of the toner on the developing roller 55 increases as shown in FIG. 10 in the same manner as the first embodiment. However, as the developing roller 55 rotates, the amount of the toner attached to the developing roller 55 decreases, and the potential of the toner on the developing roller decreases to become a stable potential of 0 V, but printing on the recording paper begins at a time t4 even though a toner potential V1 on the developing roller 55 is still high. Where printing on the recording paper begins while the toner potential is still high, some of the toner on the developing roller 55 adversely moves to the photosensitive drum 51 irrespectively of the electrostatic latent image formed thereon and attaches to the recording paper, thereby smearing the recording paper.

The image forming apparatus according to the third embodiment is made to solve the above problem. The image forming apparatus goes into the cleaning period of the charging roller 52 from the time t0 at the end of the print job or during printing. At this moment, the ID unit 100 is driving under the control of the speed control unit 300.

At the time t0 from which the cleaning period starts, the voltage application control unit 400 controls the power source 204 not to apply the electrostatic removing voltage to the electrostatic removing unit 109. From during printing to the time t0, the voltage application control unit 400 keeps on controlling the power sources 201, 202, and 203 to apply the voltage of the same polarity as the toner to the charging roller 52, the voltage of the same polarity as the toner to the developing roller 55, and the voltage of the same polarity as the toner to the supply roller 56.

At the time t1 when a portion of the photosensitive drum 51 that was located at the electrostatic removing unit 109 at the time t0 reaches the charging roller 52, the voltage application control unit 400 controls the power source 201 not to apply the voltage of the same polarity as the toner to the charging roller 52.

The voltage applied to the charging roller 52 is stopped, so that the toner and the silica attached to the charging roller 52 that the cleaning device 108 has failed to remove move to the photosensitive drum 51, and thus the charging roller 52 is cleaned. At this moment, the charging roller 52 does not charge the surface of the photosensitive drum 51 because no charging voltage is applied to the charging roller 52 from the power source 201. However, the potential of the surface of the photosensitive drum 51 does not become 0V but has a certain potential according to the Paschen's law because the power source 204 is controlled at the time t0 not to apply the electrostatic removing voltage to the electrostatic removing unit 109.

At a time t2 when a portion of the photosensitive drum 51 that was in contact with the charging roller 52 at the time t1 reaches the developing roller 55, the voltage of the photosensitive drum 51 at the developing roller 55 decreases to a certain voltage according to the Paschen's law as shown in FIG. 11. The voltage application control unit 400 controls the power source 202 to apply to the developing roller 55 a voltage (for example 0V) equal to or less than a difference between a voltage applied by the power source 202 to the developing roller 55 during printing and a voltage applied by the power source 203 to the supply roller 56 during printing. The voltage application control unit 400 controls the power source 203 applying the voltage of the same polarity as the toner to the supply roller not to apply the voltage to the supply roller 56.

In the conventional image forming apparatus of FIG. 10, the voltage application control unit 400 controls the power source 202 to apply a voltage opposite to the toner to the developing roller 55 to prevent the toner from moving from the developing roller 55 to the photosensitive roller 51 because the potential of the photosensitive drum is approximately 0V. However, in the image forming apparatus according to the third embodiment of the invention as shown in FIG. 11, the toner does not move from the developing roller 55 to the photosensitive drum 51 even if the power source 202 is controlled to apply a voltage of, for example, 0V to the developing roller 55 because the photosensitive drum 51 has a certain potential according to the Paschen's law. Therefore, the image forming apparatus of the third embodiment can prevent the toner from moving to the photosensitive drum 51 while still allowing the voltage application control unit 400 to control the power supply 202 to apply 0V to the developing roller at the time t2.

At a time t3 when a prescribed time has passed, the voltage application control unit 400 controls the power source 204 to apply the electrostatic removing voltage to the electrostatic removing unit 109.

At a time t4 when a portion of the photosensitive drum 51 that was located at the electrostatic removing unit 109 at the time t3 reaches the charging roller 52, the voltage application control unit 400 controls the power supply 201 to apply a voltage of the same polarity as the toner to the charging roller 52. Thus, the charging roller 52 charges the surface of the photosensitive drum 51.

At a time t5 when a portion of the photosensitive drum having been contacted and charged by the charging roller 52 reaches the developing roller 55 along with the rotation of the photosensitive drum 51, the potential of the photosensitive drum 51 at the developing roller 55 increases. At the time t5, the voltage application control unit 400 controls the power source 202 to apply a voltage of the same polarity as the toner to the developing roller 55 in order to start developing the charged area of the photosensitive drum 51. Furthermore, the voltage application control unit 400 controls the power source 203 to apply the voltage of the same polarity as the toner to the supply roller 56.

At the time t5, the voltage application control unit 400 controls the power source 203 to change the voltage applied to the developing roller 55 to a voltage of the same polarity as the toner for printing from a voltage equal to or less than a difference between a voltage applied by the power source 202 to the developing roller 55 during printing and a voltage applied by the power source 203 to the supply roller 56 during printing. As described above, in the cleaning period, the voltage application control unit 400 controls the power source 203 to apply to the developing roller 55 a voltage equal to or less than a difference between a voltage applied by the power source 202 to the developing roller 55 during printing and a voltage applied by the power source 203 to the supply roller 56 during printing instead of a voltage of a polarity opposite to the toner, so that the image forming apparatus of the third embodiment of the invention prevents the increase of the potential of the toner on the photosensitive drum 55, and the maximum value Vp of the potential of the toner becomes smaller than that of the conventional image forming apparatus.

At a time t6 from which printing on the recording paper begins, the potential of the toner on the developing roller 55 becomes smaller than the toner potential V1 and becomes closer to the stable potential V0. Therefore, the image forming apparatus according to the third embodiment prevents any of the toner from moving to the photosensitive drum 51 irrespectively of the electrostatic latent image unlike the conventional image forming apparatus, and prevents the recording paper from being smeared.

As hereinabove described, the image forming apparatus according to the third embodiment of the invention does not apply the electrostatic removing voltage to the electrostatic removing unit during the cleaning period, so that the potential on the surface of the photosensitive drum 51 does not become 0V but keeps a certain voltage. Therefore, the image forming apparatus does not require a voltage of a polarity opposite to the toner to be applied to the developing roller 55 to prevent the toner from moving from the developing roller 55 to the photosensitive drum 51. Because no voltage of the polarity opposite to the toner is applied to the developing roller 55 during the cleaning period, the potential of the toner does not increase when the voltage of the same polarity as the toner is applied to the developing roller 55 after the cleaning period of the charging roller 52, and the image forming apparatus prevents any of the toner on the photosensitive drum 51 from moving to the photosensitive drum 51 irrespectively of the electrostatic latent image, thereby preventing the recording paper from being smeared.

A printer is described in the above embodiments as an example of the image forming apparatus of the present invention but this invention can be applied to MFP (Multi Function Printer), facsimile, photocopier, and the like.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

What is claimed is:

1. An image forming apparatus comprising:

an image carrier rotating and having an electrostatic latent image formed by exposure of a charged surface of said image carrier to light and developed with developer charged to a predetermined polarity;

a charging member charging said image carrier;

a developing member arranged on a downstream side in a rotational direction of said image carrier with respect to said charging member for attaching said developer onto said image carrier to develop the formed electrostatic latent image;

a supplying member supplying said developer to said developing member;

an electrostatic removing unit neutralizing a potential on said surface of said image carrier;

a developing member voltage application unit applying a voltage to said developing member;

a supplying member voltage application unit applying a voltage to said supplying member;

an electrostatic removing unit voltage application unit applying an electrostatic removing unit voltage to said electrostatic removing unit; and a voltage application control unit controlling the voltage applied to said developing member by said developing member voltage application unit, the voltage applied to said supplying member by said supplying member voltage application unit, and the voltage applied to said electrostatic removing unit by said electrostatic removing unit voltage application unit, wherein where a voltage applied to said charging member from a charging member voltage application unit is changed, said voltage application control unit controls said electrostatic removing unit voltage application unit not to apply the electrostatic removing unit voltage to said electrostatic removing unit.

2. The image forming apparatus according to claim 1, wherein the voltage applied to said charging member is lower when said charging member faces a portion of said image carrier to which portion said electrostatic removing unit has applied no voltage than when said charging member faces a portion of said image carrier to which portion said electrostatic removing unit has applied the voltage.

3. The image forming apparatus according to claim 1, wherein no voltage is applied to said charging member when said charging member faces a portion of said image carrier to which portion said electrostatic removing unit has applied no voltage.

4. The image forming apparatus according to claim 1, wherein where said voltage application control unit changes the voltage applied to said charging member, the voltage applied by said developing member voltage application unit to said developing member is zero volt.

5. The image forming apparatus according to claim 1, wherein where said voltage application control unit changes the voltage applied to said charging member, the voltage applied by said supplying member voltage application unit to said supplying member is turned off.

6. The image forming apparatus according to claim 1, wherein when said developing member faces a portion of said image carrier to which portion said electrostatic removing unit has applied no voltage, the voltage applied by said developing member voltage application unit to said developing member is zero volt.

7. The image forming apparatus according to claim 1, wherein when said developing member faces a portion of said image carrier to which portion said electrostatic removing unit has applied no voltage, the voltage applied by said supplying member voltage application unit to said supplying member is turned off.

8. The image forming apparatus according to claim 1, wherein where said voltage application control unit changes the voltage applied to said charging member, said voltage application control unit controls said developing member voltage application unit to apply to said developing member a voltage equal to or less than a difference between a voltage applied by said developing member voltage application unit to said developing member during image formation and a voltage applied by said supplying member voltage application unit to said supplying member during image formation.

9. The image forming apparatus according to claim 1, wherein where said voltage application control unit changes the voltage applied to said charging member, a difference between the voltage applied by said developing member voltage application unit to said developing member and the voltage applied by said supplying member voltage application unit to said supplying member is zero volt.

10. The image forming apparatus according to claim 1, wherein when said developing member faces a portion of said image carrier to which portion said electrostatic removing unit has applied no voltage, said voltage application control unit controls said developing member voltage application unit to apply to said developing member a voltage equal to or less than a difference between a voltage applied by said developing member voltage application unit to said developing member during image formation and a voltage applied by said supplying member voltage application unit to said supplying member during image formation.

* * * * *